US005558758A

United States Patent [19]

Foster

[11] Patent Number: 5,558,758

[45] Date of Patent: Sep. 24, 1996

[54] ELECTRODEPOSITED COMPOSITE COATINGS

[75] Inventor: John Foster, Weston-Super-Mare, Great Britain

[73] Assignee: Praxair S.T. Technology, Inc., Danbury, Conn.

[21] Appl. No.: 211,506

[22] PCT Filed: Aug. 5, 1993

[86] PCT No.: PCT/GB93/01659

§ 371 Date: Aug. 31, 1994

§ 102(e) Date: Aug. 31, 1994

[87] PCT Pub. No.: WO94/03656

PCT Pub. Date: Feb. 17, 1994

[30] Foreign Application Priority Data

Jul. 6, 1992 [GB] United Kingdom ..... 9216706

[51] Int. Cl.[6] ..... C25D 15/00

[52] U.S. Cl. ..... 205/50; 205/109; 205/110; 205/228; 205/319; 427/304; 427/437; 428/614; 428/668; 428/679; 428/935

[58] Field of Search ..... 205/224, 228, 205/109, 110, 50, 319; 427/437, 304; 428/614, 668, 679, 935

[56] References Cited

U.S. PATENT DOCUMENTS 3,532,608 10/1970 Serra ..... 205/319
4,789,441 12/1988 Foster et al. ..... 205/50

FOREIGN PATENT DOCUMENTS 52-3894 1/1977 Japan .
61-133399 6/1986 Japan .
1358538 7/1974 United Kingdom .

*Primary Examiner*—John Niebling
*Assistant Examiner*—Edna Wong
*Attorney, Agent, or Firm*—Tejpal S. Hansra; Douglas E. Denninger

[57] ABSTRACT

An electrodeposited composite coating comprises, as deposited, a matrix of cobalt and particles of chromium carbide, at least 50% and preferably at least 80% or 90% by weight of the particles lying within the size range of 4 μm to 8 μm.

28 Claims, 2 Drawing Sheets

ELECTRODEPOSITED COMPOSITE COATINGS

This invention relates to electrodeposited composite coatings, i.e. coatings which consist of an electrolytically or electrolessly plated metal matrix with included particles which are codeposited with the matrix. The particles are suspended in the electrolyte containing the metal ions for the matrix and are substantially insoluble in the electrolyte and, during the plating operation, become included in the plated matrix.

The coatings may be applied to a variety of components subjected to wear such as aero-engine components, particularly those likely to operate at elevated temperatures, bearing surfaces, rocket nozzles, and tubes and nozzles carrying abrasive substances. The coatings may be applied to the whole component but more frequently they will be applied to only a portion of its surface. The electrodeposition technique is particularly suitable to the protection of selected areas and the coating of complex, re-entrant and inaccessible areas do not present any great problems. The coatings are particularly suited to use on gas turbine blades.

Our United Kingdom patent GB-A-1358538 describes a composite coating comprising, as deposited, a matrix which is at least 50% by weight cobalt and particles included in the matrix which are at least 50% by weight chromium carbide, at least 50% by weight of the particles having a particle size of less than ten microns and preferably between 2 and 5 microns.

The specification of GB-A-1358538 indicates that although preferably all the particles have a size between 2 and 5 microns it may not be practicable completely to avoid a small quantity of fines below 2 microns and possibly some larger particles due, for example, to agglomeration but states that preferably more than 80% by weight of the particles lie within the specified limits, i.e. between 2 and 5 microns.

The processes described in GB-A-1358538 have been used for approximately twenty years with very great success. The particles which have been used have had a size distribution within the range set out, i.e. most of the particles having a size between 2 and 5 μm. The particles used have been much as received from the supplier but, as will be explained below, some small adjustment has sometimes been made by removing a proportion of the larger particles. It has been found that coatings are produced having an as-deposited composition range of between 13 and 20 percent by weight of chromium carbide dispersed in a cobalt matrix. The as-deposited coatings are somewhat modified by diffusion produced by heat treatment and/or heat resulting from use of the components carrying the coatings. These coatings perform well under rubbing/ fretting wear conditions where the pressure-velocity (PV) values are moderate. It would be advantageous for the properties of the coatings to be improved so that they can operate at higher PV values and in conditions involving hammer or impact forces. It is felt that a more robust coating could be obtained if the weight fraction of carbide particles could be increased. It has now been discovered that the fraction of carbide particles in the as-deposited coating can be increased to a very surprising degree by providing for most of the particles to fall within the size range of 4 to 12 μm and preferably with a mean size of 7 μm. Preferably 80% and more preferably 90% by weight of the particles are within the 4 to 12 μm range. By mean size is meant that half the particles by weight have a size less than 7 μm and half have a size equal to or larger than 7 μm. Alternatively, the invention may be said to reside in using particles at least 80% by weight of which exceed 4 μm in size and at least 80% of which lie within a range of 4 μm to 8 μm (and preferably with the upper end of the range not exceeding 20 μm). Preferably, the particles are substantially evenly distributed in size across the range.

The invention also includes, according to a further aspect, a method of producing a coating comprising depositing by electrodeposition or by electroless deposition a matrix of cobalt and codepositing with the matrix particles of chromium carbide suspended in the plating bath, 80% by weight of the particles falling within the size range of 4 to 12 μm.

The invention is particularly suited to coatings in which substantially all the particles are chromium carbide and the matrix is substantially all cobalt.

The deposited coatings will usually be heat treated, for example at a temperature above 500° C. for a period in excess of two hours, to produce diffusion of material between the matrix and the particles.

The invention may be performed in various ways but one way of carrying out the process will now be described generally and by way of example with reference to the accompanying diagrammatic drawings showing apparatus suitable for carrying out the process; in addition a specific example of a process utilising this apparatus will now be described. In the drawings.

Figure 1:
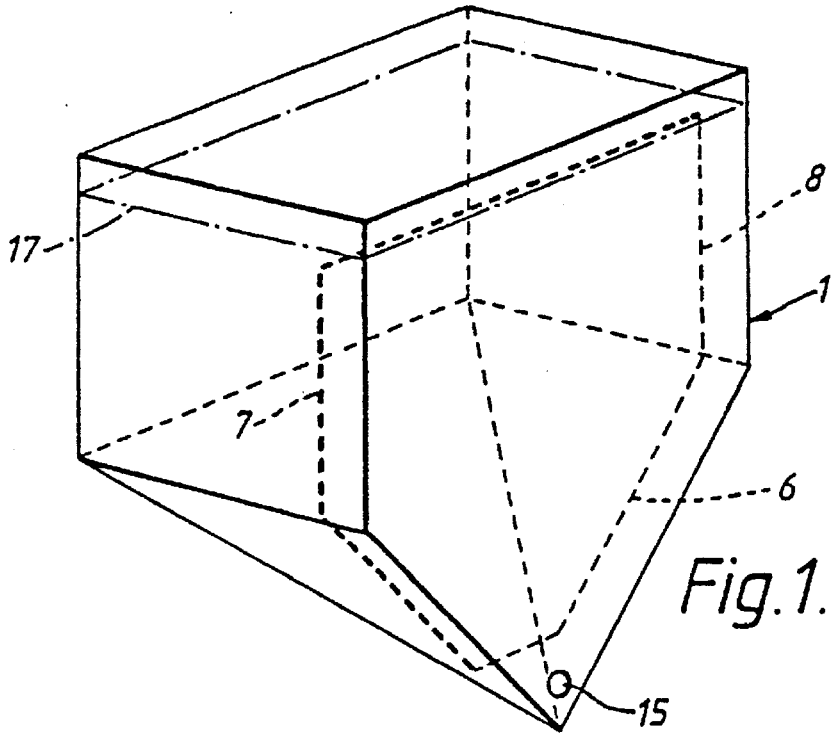
FIG. 1 is a perspective view of the apparatus.

The apparatus shown in the drawings, comprises a vessel or container 1 having a parallelepiped shaped upper portion 2 and a downwardly tapering lower portion 3 in the form of an inverted pyramid which is skewed so that one side face 4 forms a continuation of one side face 5 of the upper portion.

The vessel 1 contains a partition 6 which lies in a vertical plane parallel to the side faces 4 and 5 of the vessel and makes contact at its side edges 7 and 9 with the adjacent vertical and sloping faces of the vessel. The partition thus divides the vessel into a larger working zone 9 and a smaller return zone 11. At its bottom the partition 6 terminates at a horizontal edge 12 above the bottom of the vessel to afford an interconnection 13 between the working zone 9 and the return zone 11. At its top, the partition 6 terminates at a horizontal edge 14 below the top edges of the vessel 1.

At the bottom of the return zone 11 there is an air inlet 15 which is connected to an air pump (not shown). Mounted in the working zone 9 is a jig 16 to which the workpiece to be coated is mounted, the jig 16 being mounted for rotation about a horizontal axis parallel to the plane of the partition and motor means (not shown) is provided to rotate the jig.

Conductors are provided to apply a voltage to the workpiece mounted on the jig 16 relative to a cobalt anode which is suspended in the working zone.

To use the apparatus, the workpiece is mounted on the jig 16 which is positioned in the vessel as shown. Before or after the positioning of the jig, the vessel is filled to a level 17 above the top edge 14 of the partition 6 with a cobalt plating solution containing particles of chromium carbide to be co-deposited. Air is admitted to the inlet 15 and this rises up the return zone 11, raising solution and entrained particles. At the top of the return zone, the air escapes and the solution and particles flow over the broad crested weir formed by the top edge 14 of the partition and flow down past the workpiece on the rotating jig 16. At the bottom of the working zone 9, the particles tend to settle and slide down the inclined sides of the vessel towards the interconnetion 13 where they are again entrained in the solution and carried round again.

As the downwardly travelling particles in the working zone 9 encounter the workpiece, they tend to settle on the workpiece where they become embedded in the metal which is being simultaneously plated out.

The article to be coated is prepared as follows. The article is first degreased by immersion in trichloroethylene or by swabbing with lint free material soaked in acetone. Areas not to be electroplated are then masked. The areas to be plated are then cleaned either mechanically by blasting with alumina shot or chemically with a suitable cleaning medium such as an acid pickle.

The current is then switched on and the prepared article placed in the solution. The air flow is adjusted to a suitable rate and the current is adjusted to give the correct current density which may, for example, be between 10 and 150 amps per square foot of surface being plated at a voltage of 15 volts. After deposition has proceeded for the appropriate time the article is withdrawn and is washed and dried. One specific example of composite electrodeposition using the general methods and the apparatus previously described will now be given.

EXAMPLE

Figure 2:
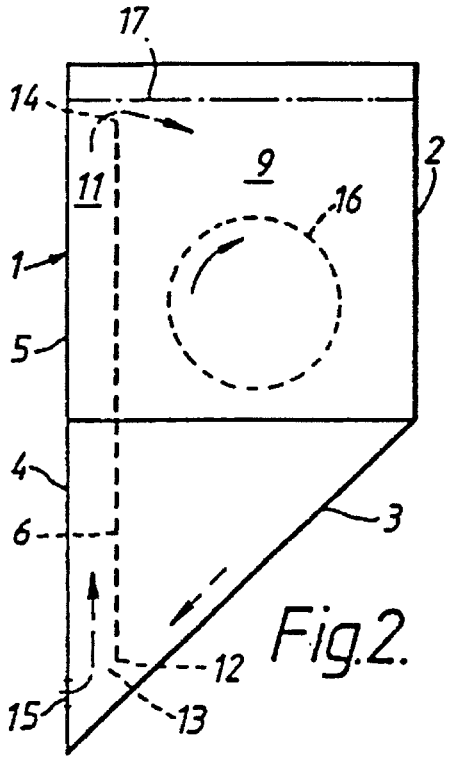
FIG. 2 is a side elevation of the apparatus.
Figure 3:
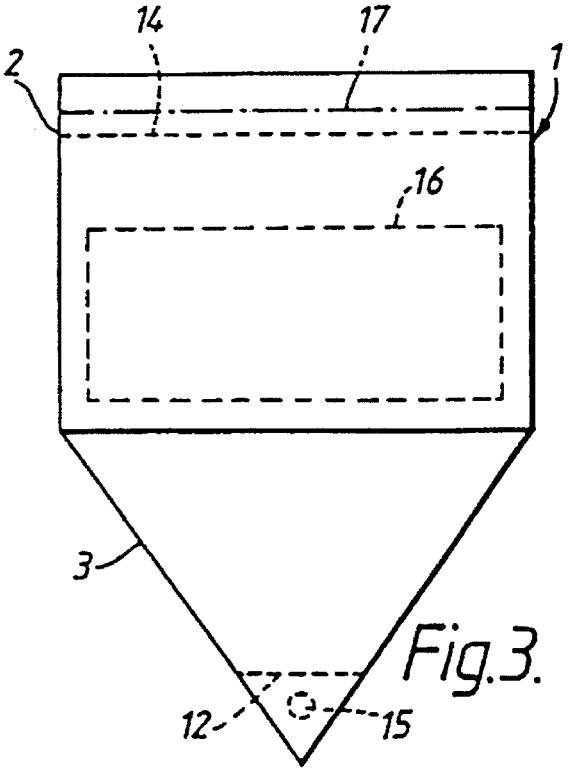
FIG. 3 is a front elevation of the apparatus.

A test piece of steel was coated in the apparatus shown in FIGS. 1 to 3. The tank contained an electrolytic bath of the following composition:

| | |
|---|---|
| Cobalt sulphate ($CoSO_4.6H2O$) | 250 g/l |
| Sodium chloride (NaCl) | 16 g/l |
| Boric acid ($H_3BO_3$) | 31 g/l |

The bath also contained 500 g/l of chromium carbide ($Cr_3C_2$) powder having a particle size distribution according to Curve R in the accompanying graph (FIG. 4) the y-axis of which represents the percentage by weight of the particles having a size below a size indicated in μms on the x-axis. Curve R shows a size distribution in accordance with the present invention. The bath had a pH of 4.7 and during deposition it was maintained at a temperature of approximately 50° C.

The test piece was first degreased in trichlorethylene vapour and was then shot blasted with grade 50μ alumina shot. The pump 3 was then switched on and when the particles had become distributed through the bath the test piece was connected to the current supply as the cathode and was inserted in the bath. The current was adjusted to give a density of 4 A/dm$^2$. After a time sufficient to produce a coating thickness of 125 μm the test piece was removed from the bath and was washed and dried.

The test piece was then heat treated by being maintained at a temperature of 1,000° C. for four hours followed by an oil quench.

Figure 4:
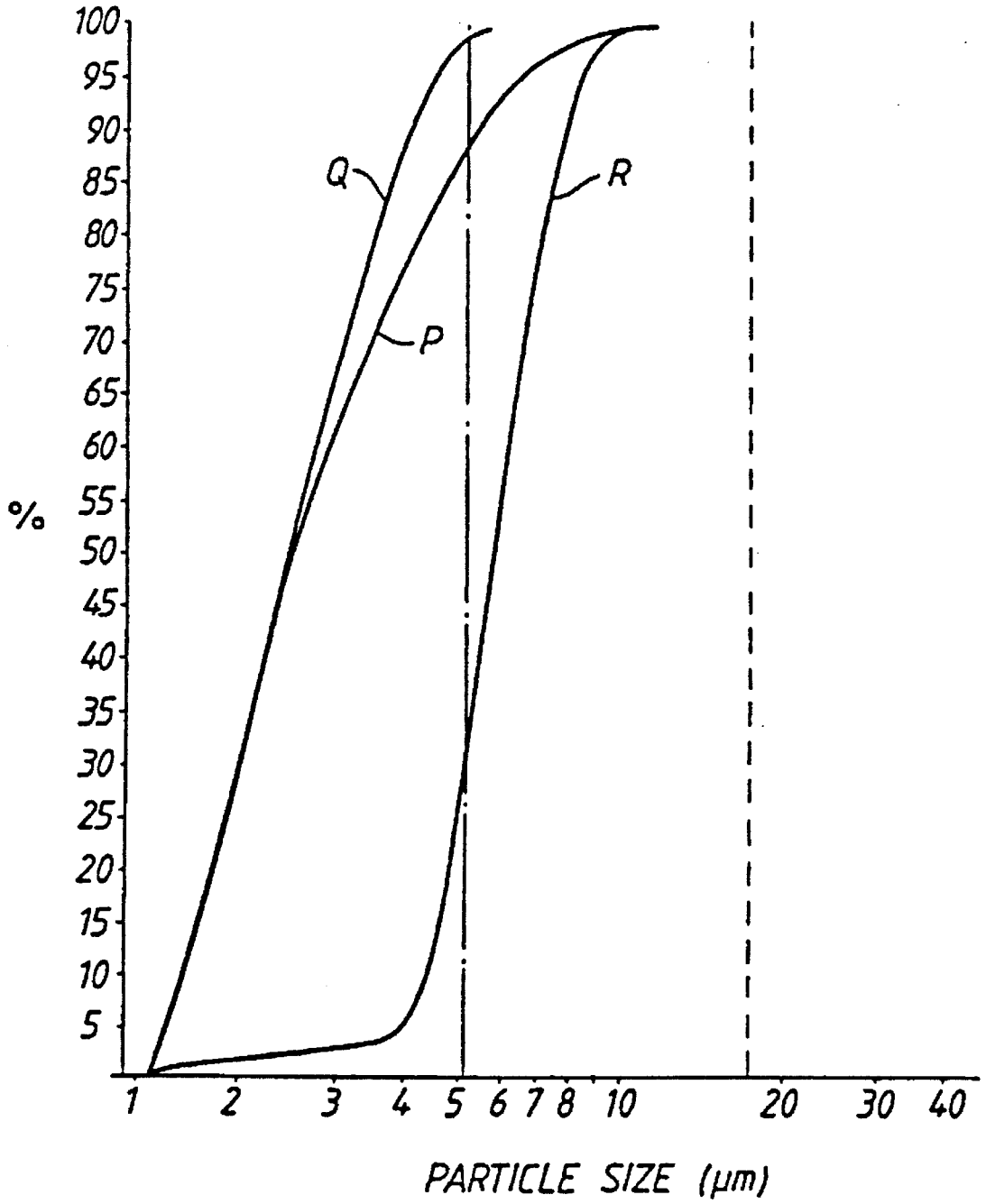
FIG. 4 is a graph showing particle size distributions.

Similar test pieces were produced using a similar bath but with particles having size distributions according to Curve Q in FIG. 4. It should be explained that Curve P shows the size distribution of the as-received powder while Curve Q shows the size distribution of the as-received powder modified by the removal of a proportion of the larger particles as has been the practice hitherto.

In comparative tests of the coatings produced as described above it was found that, using particles having a size range of 1 to 8 μm and a mean size of 3.8 μm (Curve Q), a coating (Coating A) was obtained having 19 weight percent of particles whereas, using particles having a size range of 4 to 12 μm with a mean size of 7 μm (Curve R), a coating (Coating B) was obtained with 35 weight percent of particles. These coatings were tested for their hardness and wear properties and the second were found to have remarkably improved performance. In the tests, the coatings were subjected to a high PV environment, namely a Hertzian contact stress of 200 N/mm$^2$, a sliding velocity of 0.13 m/s and a temperature of 450° C. It was found that Coating A had a hardness (Vickers Hardness Number VHN) of 350 while Coating B had a hardness of 500 and that Coating A had a Rubbing Wear Factor indicating the amount of wear of 4 while Coating B had a Rubbing Wear Factor of 0.06. It will be appreciated that the tests show that Coating B was much superior to Coating A.

The properties of Coatings A and B are set out in the following Table 1:

TABLE 1

| | Coating A | Coating B |
|---|---|---|
| Particle size range in μm | 1–8 | 4–12 |
| Mean size of particles | 3.8 | 7 |
| Particle content (weight percent) coating | 19 | 35 |
| Hardness of coating VHN | 350 | 500 |
| Rubbing Wear Factor | 4 | 0.06 |

It will be appreciated that coatings in accordance with the present invention can be produced by the methods described in GB-A-1358538 and the apparatus described in GB-A-1218179, GB-A-1329081 and GB-A-2182055 to which reference should be made for further details.

Tests were also conducted to compare Coating B with well-known wear-resistant coatings and the results are shown in Table 2. The tests were conducted by reciprocating a loaded round-bottomed disc of 15 mm diameter on a flat plate. The underside of the disc had a part-spherical shape with a diameter of 30 mm. In each case, the load on the disc was 2N, the disc was reciprocated at a speed of 0.13 m/sec, the test was conducted at a temperature of 450° C. and had a duration of 180 minutes. Both the underside of the disc and the upper surface of the plate were coated with the same material. After each test period, the underside of the disc was measured for wear and the wear is given in the table in m$^3$/Nmx10$^{-15}$. For each material, two samples were prepared and tested. It will be seen from the table that Coating B suffered very significantly lower wear than any of the other materials.

TABLE 2

| Test | Material | Material type/ Coating method | Wear m$^3$/Nm × 10$^{-15}$ |
|---|---|---|---|
| 1 | Ti-6Al-4V | Ti Alloy | 480 |
| 2 | Ti-6Al-4V | Ti Alloy | 480 |
| 3 | Inconel 718 | A superalloy | 6.9 |
| 4 | Inconel 718 | A superalloy | 5.9 |
| 5 | $Si_3N_4$ | Bulk ceramic, hot pressed | 490 |
| 6 | $Si_3N_4$ | Bulk ceramic, hot pressed | 320 |
| 7 | TiC | Chemical vapour deposition | 1.0 |
| 8 | TiC | Chemical vapour deposition | 7.9 |
| 9 | WC-18% Co | Plasma sprayed | 0.6 |
| 10 | WC-18% Co | Plasma sprayed | 1.3 |

TABLE 2-continued

| Test | Material | Material type/ Coating method | Wear $m^3/Nm \times 10^{-15}$ |
|---|---|---|---|
| 11 | 90% Sic-10% Si | Bulk ceramic, sintered | 45 |
| 12 | 90% Sic-10% Si | Bulk ceramic, sintered | 94 |
| 13 | Co—$Cr_2C_3$ | Coating B | 0.06 |
| 14 | Co—$Cr_2C_3$ | Coating B | 0.09 |

I claim:

1. An electrodeposited wear resistant composite coating comprising, as deposited, a matrix which is at least 50% by weight cobalt and particles included in the matrix which are at least 50% by weight chromium carbide, at least 50% by weight of the particles fall within the size range of 4 to 12 μm, the particles being substantially evenly distributed in size across the said size range.

2. A coating according to claim 1 in which 80% by weight of the particles fall within the size range of 4 to 12 μm.

3. A coating according to claim 1 in which 90% by weight of the particles fall within the size range of 4 to 12 μm.

4. A coating according to claim 1 in which the particles have a mean size of 7 μm.

5. A coating according to claim 1 in which substantially all of the particles are chromium carbide.

6. A coating according to claim 1 in which the matrix is substantially all cobalt.

7. An electrodeposited wear resistant composite coating comprising, as deposited, a matrix of cobalt and particles of chromium carbide included in the matrix, at least 80% by weight of the particles lie within the size range of 4 μm to 8 μm, the particles being substantially evenly distributed in size across the said size range.

8. A coating as claimed in claim 7 in which substantially none of the particles has a size greater than 20 μm.

9. A method of producing a wear resistant coating which comprises providing a substrate, depositing by electrodeposition or by electroless deposition a matrix of cobalt on the substrate and codepositing with the matrix particles of chromium carbide suspended in a plating bath, 80% by weight of the particles falling within the size range of 4 to 12 μm, the particles being substantially evenly distributed in size across the said size range.

10. A method according to claim 9 in which the deposited coating is heat treated to produce diffusion of material between the matrix and the particles.

11. A coating according to claim 2 in which substantially all of the particles are chromium carbide.

12. A coating according to claim 3 in which substantially all of the particles are chromium carbide.

13. A coating according to claim 4 in which substantially all of the particles are chromium carbide.

14. A coating according to claim 2 in which the matrix is substantially all cobalt.

15. A coating according to claim 3 in which the matrix is substantially all cobalt.

16. A coating according to claim 4 in which the matrix is substantially all cobalt.

17. A coating according to claim 5 in which the matrix is substantially all cobalt.

18. A coating according to claim 2 in which the particles have a mean size of 7 μm.

19. A coating according to claim 3 in which the particles have a mean size of 7 μm.

20. A coating according to claim 18 in which substantially all of the particles are chromium carbide.

21. A coating according to claim 19 in which substantially all of the particles are chromium carbide.

22. A coating according to claim 18 in which the matrix is substantially all cobalt.

23. A coating according to claim 19 in which the matrix is substantially all cobalt.

24. A coating according to claim 20 in which the matrix is substantially all cobalt.

25. A coating according to claim 21 in which the matrix is substantially all cobalt.

26. A coating according to claim 11 in which the matrix is substantially all cobalt.

27. A coating according to claim 12 in which the matrix is substantially all cobalt.

28. A coating according to claim 13 in which the matrix is substantially all cobalt.

* * * * *